US010217310B2

(12) United States Patent
Ma et al.

(10) Patent No.: US 10,217,310 B2
(45) Date of Patent: Feb. 26, 2019

(54) VENDING MACHINE

(71) Applicant: NOODLE TIME HOLDINGS LIMITED, Kowloon (HK)

(72) Inventors: Ji Ma, Kowloon (HK); Li-Ming Sung, Kowloon (HK); Szu-Chou Peng, Kowloon (HK); Kim-Kwong Chow, Kowloon (HK)

(73) Assignee: NOODLE TIME HOLDINGS LIMITED, Kowloon (HK)

( * ) Notice: Subject to any disclaimer, the term of this patent is extended or adjusted under 35 U.S.C. 154(b) by 1 day.

(21) Appl. No.: 15/493,152

(22) Filed: Apr. 21, 2017

(65) Prior Publication Data

US 2018/0308307 A1 Oct. 25, 2018

(51) Int. Cl.
*G07F 11/24* (2006.01)
*G07F 11/10* (2006.01)

(52) U.S. Cl.
CPC ..... *G07F 11/24* (2013.01); *G07F 11/10* (2013.01)

(58) Field of Classification Search
CPC ..... G07F 11/24; G07F 11/10
USPC ..... 221/121
See application file for complete search history.

(56) References Cited

U.S. PATENT DOCUMENTS 4,109,825 A * 8/1978 Weitzman ..... G07F 11/54 221/122
4,715,113 A * 12/1987 Wickham ..... B23P 19/001 198/473.1
4,809,877 A * 3/1989 Albright ..... A61J 7/0481 221/121
5,080,257 A * 1/1992 Carnisio ..... G07F 13/10 221/113
5,253,782 A * 10/1993 Gates ..... G07F 11/54 221/105
5,522,310 A * 6/1996 Black, Sr. ..... A47J 27/14 221/113
5,605,249 A * 2/1997 Gonyea ..... G07F 11/54 221/11
6,102,246 A * 8/2000 Goulet ..... B67D 1/00 221/11
6,293,424 B1 * 9/2001 Love ..... G07B 3/04 221/121
6,941,855 B2 * 9/2005 Denisart ..... A47J 31/3628 221/113
7,051,646 B2 * 5/2006 Della Pietra ..... A47J 31/3633 99/280

(Continued)

*Primary Examiner* — Rakesh Kumar
(74) *Attorney, Agent, or Firm* — Chun-Ming shih; HDLS IPR Services

(57) ABSTRACT

A vending machine includes a rotary dispensing mechanism and a rotary arm mechanism. A control circuit inside the vending machine drives a rotary base of the rotary dispensing mechanism by a stepper motor device, so that an accommodating space of the rotary base is rotated to above an outlet of a fixed frame to discharge a vending item. At this point, a stepper motor device of the rotary arm mechanism is actuated by the control circuit inside the vending machine, and drives a rotary arm to hook out and convey the vending item discharged by the rotary dispensing mechanism. Meanwhile, a transition module at one side of the rotary arm mechanism covers a gap between an adjacent mechanism and a drawing plate, so that the item hooked out can be conveyed stably onto the drawing plate.

14 Claims, 13 Drawing Sheets

(56) References Cited

U.S. PATENT DOCUMENTS

| | | | | |
|---|---|---|---|---|
| 7,866,506 | B2 * | 1/2011 | Daniels | G06F 19/3462 221/122 |
| 8,839,987 | B2 * | 9/2014 | Doglioni Majer | G07F 13/10 141/168 |
| 8,939,276 | B2 * | 1/2015 | Pourshakour | A23L 2/02 198/550.5 |
| 9,974,411 | B2 * | 5/2018 | Righetti | A47J 31/3642 |

* cited by examiner

VENDING MACHINE

TECHNICAL FIELD

The present invention relates to a vending machine and, in particular, to a rotary dispensing mechanism and a rotary dispensing arm for a vending machine, and thereby a vending item can be stored or conveyed by rotation.

BACKGROUND

For more convenient shopping, a variety of vending machines are available in the market, like the conventional vending machine for vending cold drinks and the recently available vending machine for vending hot soups and foods.

Vending items are directly listed in a track-type display area of the vending machine. After selection is made by a customer through a user interface of the vending machine, a control circuit inside the vending machine actuates a robot arm movable in two directions (X, Y coordinates) or three directions (X, Y, Z coordinates). The X-Y or X-Y-Z coordinate robot arm thereby moves to the display area to get the item, and then the robot arm conveys the item to a slide track to let the item automatically slide to an outlet of the vending machine, or directly conveys the item to the outlet of the vending machine, so a customer can take the item.

To get the item by using the X-Y or X-Y-Z coordinate robot arm, it is required to have a sufficient space inside the vending machine to allow movement of the X-Y or X-Y-Z coordinate robot arm. Therefore, the vending machine needs to be large enough in its size.

Besides, although the X-Y or X-Y-Z coordinate robot arm can convey the vending item chosen by the customer to the outlet of the vending machine, the robot arm can only convey bottles, canned drinks, or items packaged in bags or boxes, and the robot arm is not suitable for conveying items with hot soups inside. The reason is that the X-Y or X-Y-Z coordinate robot arm moves rapidly and tends to spill the hot soups inside the items while moving rapidly. Therefore, in order to convey hot soups, a different conveying mechanism for properly conveying items with hot soups inside is required.

SUMMARY

It is an object of the present invention to provide a rotary dispensing mechanism for storing a vending item and discharging the vending item chosen by a customer by rotation.

It is another object of the present invention to provide a rotary arm mechanism, whereby a vending item can be hooked out from an adjacent mechanism at one side and conveyed stably to an adjacent mechanism at another side.

It is still another object of the present invention to provide a rotary arm mechanism, wherein a gap between adjacent mechanisms is covered by a transition module, so that the rotary arm mechanism can covey stably a vending item from an adjacent mechanism to a drawing plate of the rotary arm mechanism.

Accordingly, the present invention provides a rotary dispensing mechanism for a vending machine, installed in the vending machine, comprising: a fixed frame, a rotary base and a stepper motor device. The fixed frame includes a plurality of inlets and one outlet. The rotary base is pivotally connected inside the fixed frame. The rotary base includes an upper rotary disk, a lower rotary disk and a plurality of connection elements. The upper rotary disk and the lower rotary disk both include a plurality of through holes, and the through holes of the upper rotary disk are arranged corresponding to the through holes of the lower rotary disk. The connection elements are fixed to peripheries of the through holes, so that the connection elements are arranged around the through hole to form an accommodating space. The stepper motor device is disposed on the fixed frame, and the stepper motor device is connected to the lower rotary disk to drive the same. When the stepper motor device is actuated, the stepper motor device drives rotation of the rotary base, so that the accommodating space is rotated to above the outlet to discharge a vending item.

According to one embodiment of the present invention, the fixed frame includes an upper cover plate, a lower bottom plate and a plurality of support rods.

According to one embodiment of the present invention, the upper cover plate and the lower bottom plate each include a pivot hole.

According to one embodiment of the present invention, the inlets are disposed on the upper cover plate, and the outlet is disposed on the lower bottom plate.

According to one embodiment of the present invention, the upper rotary disk and the lower rotary disk each include a shaft pivotally connected to the corresponding pivot hole.

According to one embodiment of the present invention, a periphery of the lower rotary disk includes a gear tooth surface, and the gear tooth surface is engaged with the stepper motor device.

According to one embodiment of the present invention, the stepper motor device is disposed on the lower bottom plate, and the stepper motor device includes a transmission gear to be engaged with the gear tooth surface of the lower rotary disk.

According to one embodiment of the present invention, the stepper motor device is a stepper motor.

Accordingly, the present invention further provides a rotary arm mechanism for a vending machine, installed in the vending machine, comprising: a fixed base, a stepper motor device, a drawing plate, a transmission module, and a rotary arm. The stepper motor device is fixed onto the fixed base. The drawing plate is disposed on the fixed base. The transmission module is disposed on the fixed base and connected to the stepper motor device. The rotary arm is connected to the transmission module. The rotary arm includes an arm member, and a hook portion extends from one end of the arm member, wherein the stepper motor device is actuated by the vending machine, the stepper motor device drives the rotary arm to hook out and convey a vending item in the vending machine.

According to one embodiment of the present invention, the fixed base includes an upper plate, a lower plate and a plurality of support plates connected between the upper plate and the lower plate. A transverse plate is connected between the two support plates, and the upper plate and the transverse plate each include a penetrating hole.

According to one embodiment of the present invention, the stepper motor device is fixed at one side of the transverse plate, the stepper motor device includes a rotary shaft, and the rotary shaft is inserted through the penetrating hole of the transverse plate.

According to one embodiment of the present invention, the stepper motor device is a stepper motor.

According to one embodiment of the present invention, the drawing plate is one-fourth circle shaped and is disposed on the upper plate of the fixed base.

According to one embodiment of the present invention, the drawing plate consists of stainless steel.

According to one embodiment of the present invention, the transmission module includes a bearing base, a bearing and a transmission shaft, the bearing base is disposed on the penetrating hole of the upper plate, the bearing is disposed in the bearing base, and the transmission shaft is inserted through the bearing to fixedly connect the stepper motor device.

According to one embodiment of the present invention, an opening is defined on the other end of the arm member, and the rotary arm is fixed onto the transmission module via the opening.

According to one embodiment of the present invention, the hook portion is in a bent blade shape.

According to one embodiment of the present invention, the rotary arm mechanism further comprises a transition module, the transition module is disposed in the fixed base, the transition module includes two pivot portions disposed symmetrical to each other, and a movable plate is pivotally connected between the two pivot portions.

According to one embodiment of the present invention, the transition module returns to its original position by a magnet.

BRIEF DESCRIPTION OF THE DRAWINGS

The disclosure will become more fully understood from the detailed description, and the drawings given herein below is for illustration only, and thus does not limit the disclosure, wherein.

DETAILED DESCRIPTION

Detailed descriptions and technical contents of the present invention are illustrated below in conjunction with the accompany drawings.

Figure 1:
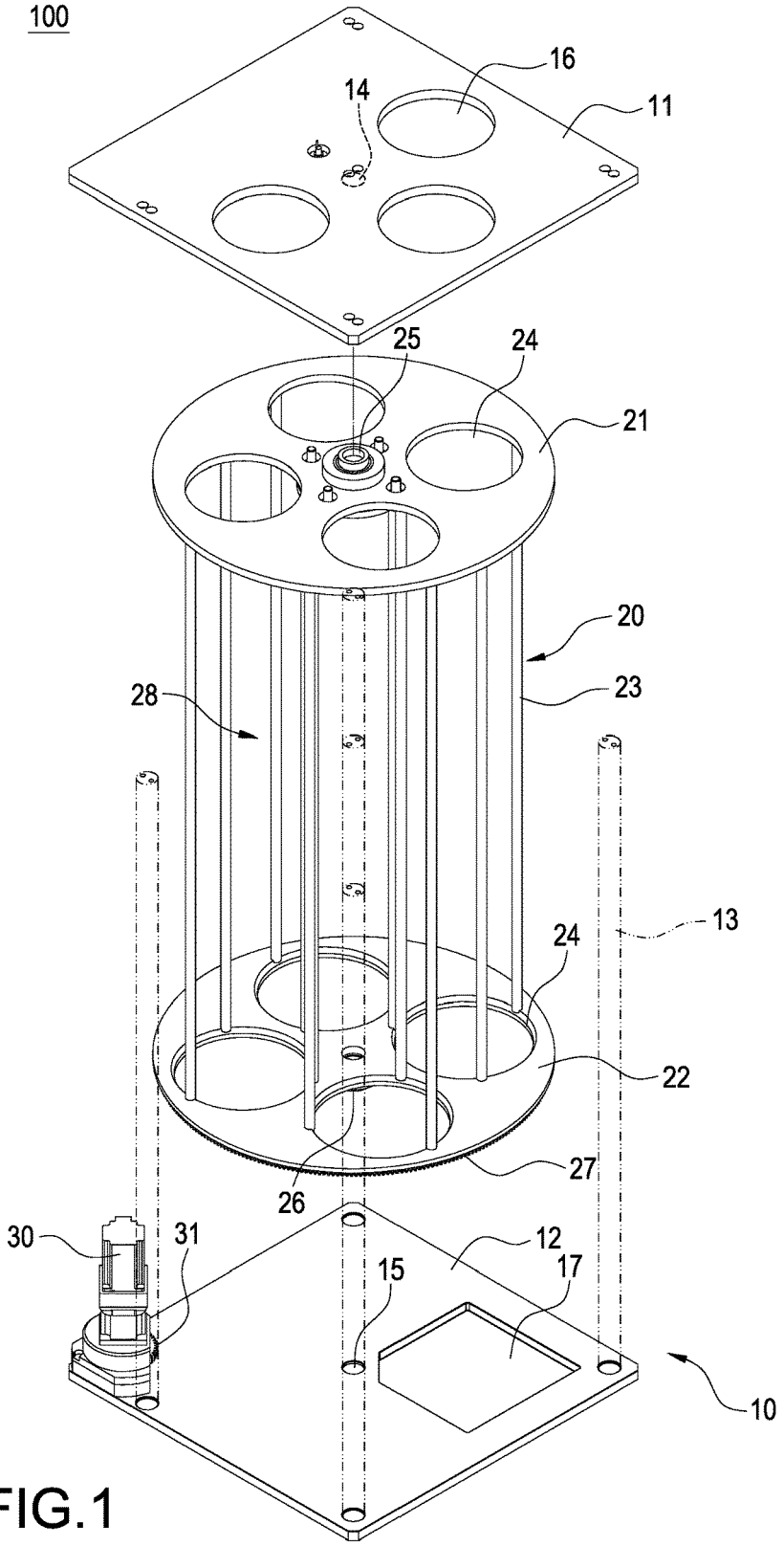
FIG. 1 is an exploded view illustrating a rotary dispensing mechanism according to the present invention.
Figure 2:
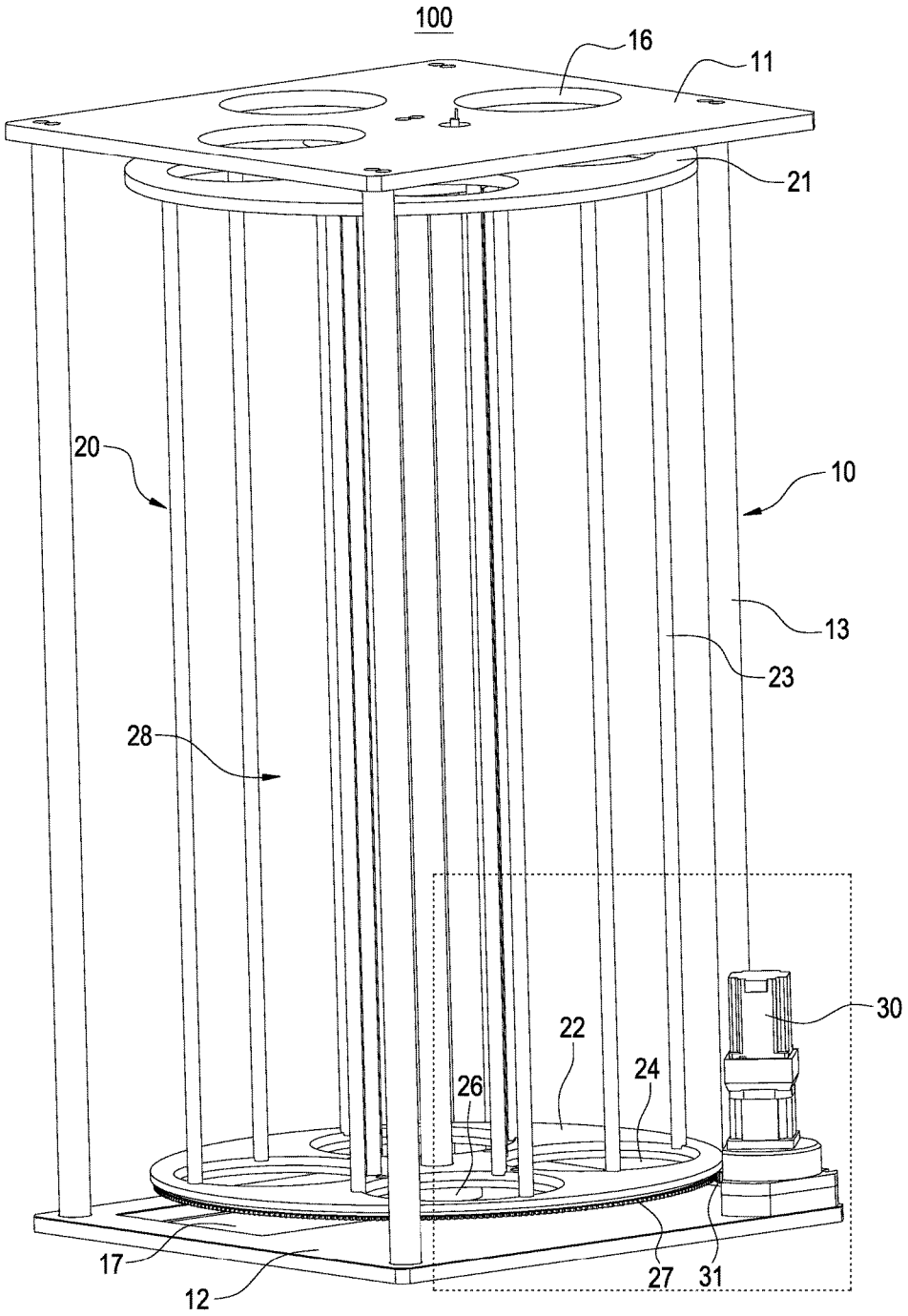
FIG. 2 is a perspective assembled view illustrating the rotary dispensing mechanism according to the present invention.
Figure 3:
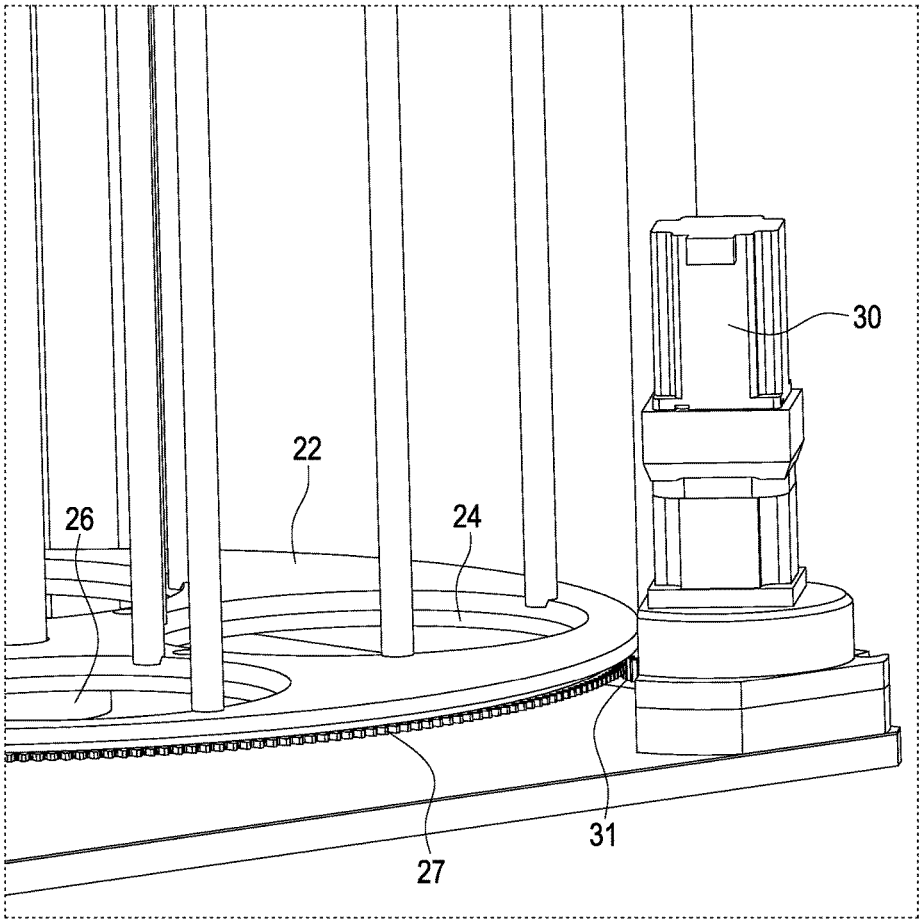
FIG. 3 is a partial enlarged view illustrating the rotary dispensing mechanism of FIG. 2.
Figure 4:
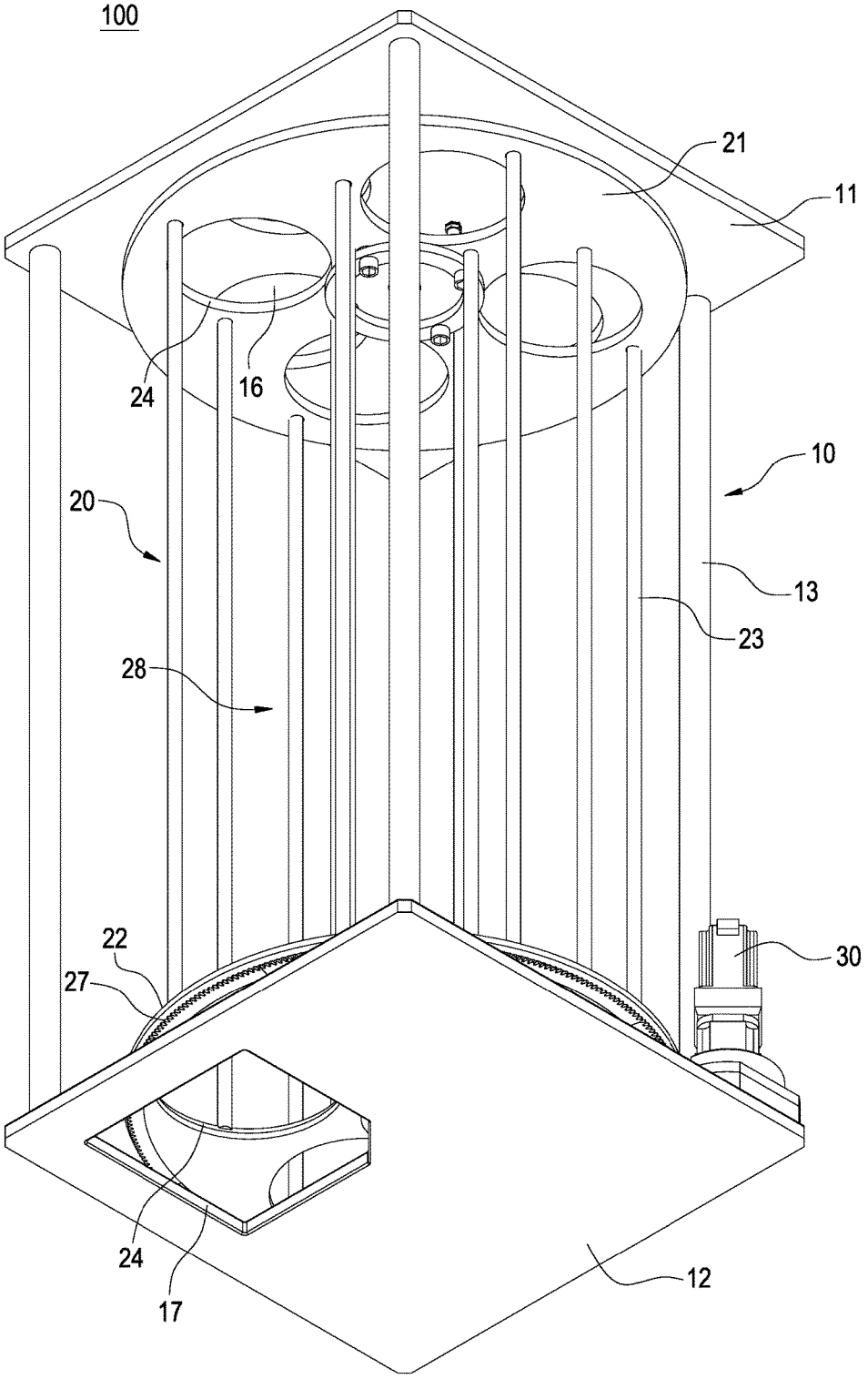
FIG. 4 is a bottom view illustrating the rotary dispensing mechanism of FIG. 2.
Figure 5:
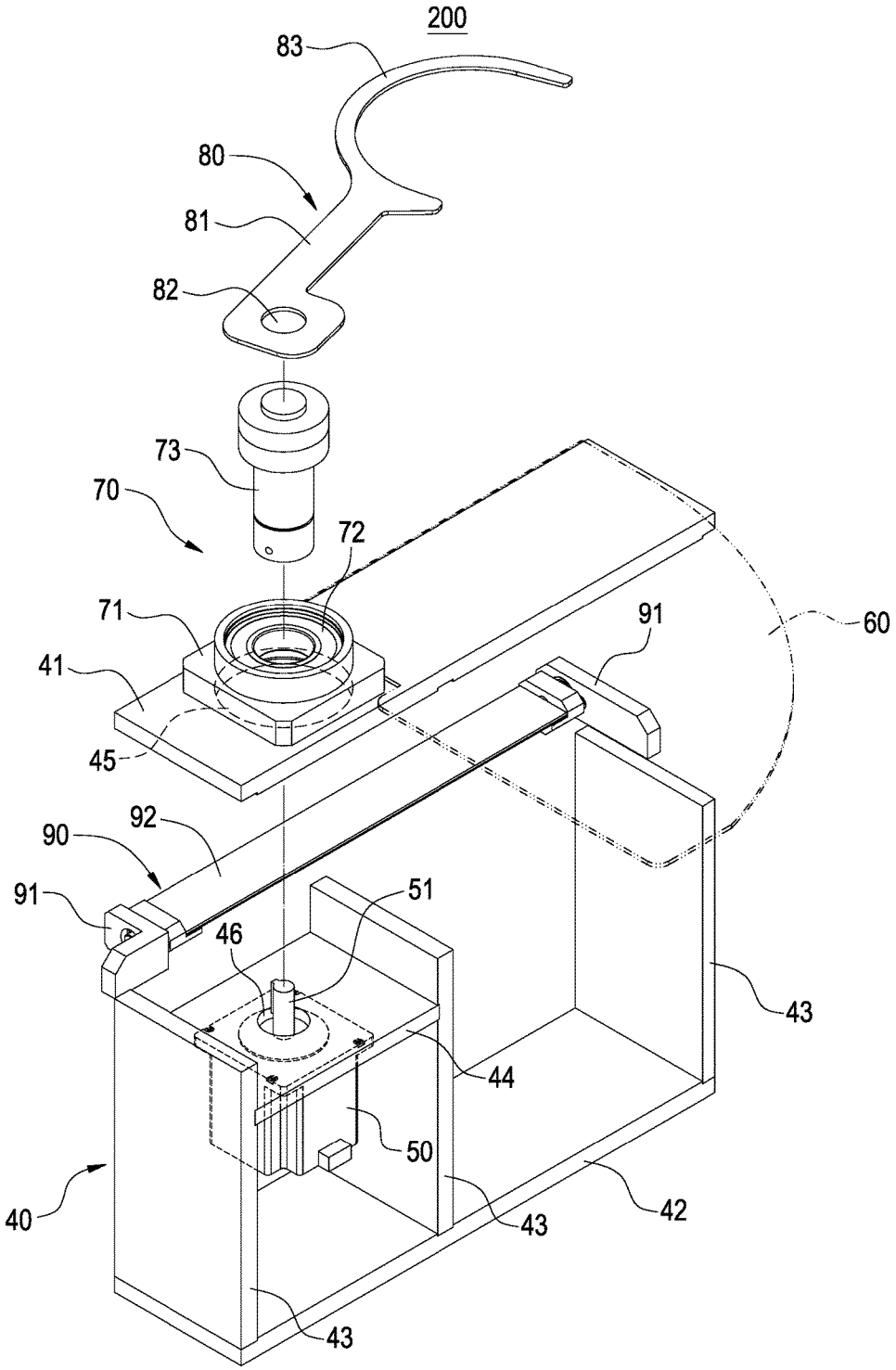
FIG. 5 is an exploded view illustrating a rotary arm mechanism according to the present invention.
Figure 6:
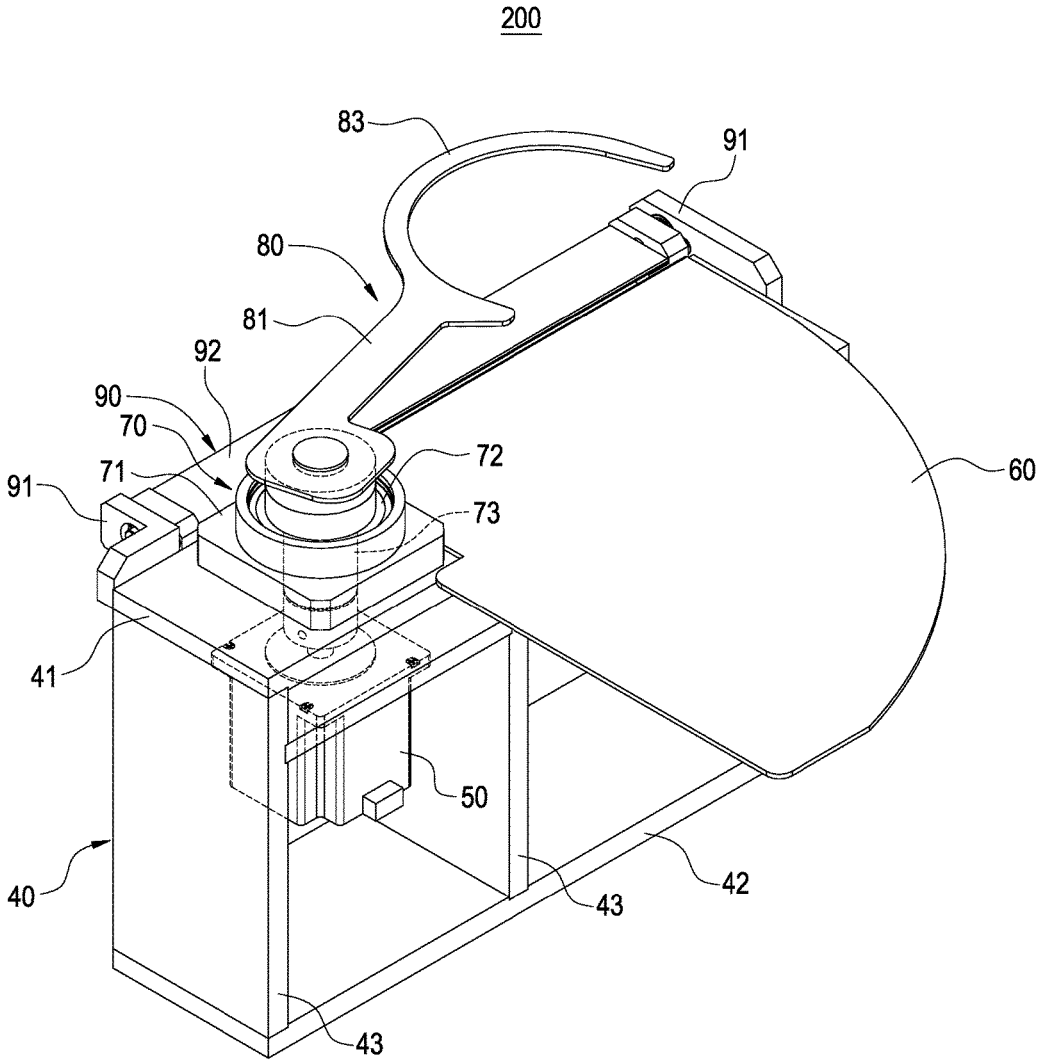
FIG. 6 is a perspective assembled view illustrating the rotary arm mechanism according to the present invention.

Please refer to FIGS. 1 to 6, which are an exploded view, an assembled view, a partial enlarged view of FIG. 2, a bottom view illustrating a rotary dispensing mechanism, and an exploded view, an assembled view illustrating a rotary arm according to the present invention. As shown in the drawings, a vending machine includes a rotary dispensing mechanism 100 and a rotary arm mechanism 200. The rotary dispensing mechanism 100 stores a vending item in the vending machine (not illustrated). After the vending item is chosen by a customer, a control circuit inside the vending machine controls the rotary dispensing mechanism 100 to be rotated to discharge the vending item, and then the rotary arm mechanism 200 deliver the vending item to an adjacent mechanism for subsequent processes.

The rotary dispensing mechanism 100 includes a fixed frame 10, a rotary base 20 and a stepper motor device 30. The fixed frame 10 is disposed inside the vending machine. The fixed frame 10 includes an upper cover plate 11, a lower bottom plate 12 and a plurality of support rods 13. The upper cover plate 11 and the lower bottom plate 12 have two pivot holes 14, 15 respectively. The two pivot holes 14, 15 are adapted to be pivotally connected with the rotary base 20. The upper cover plate 11 includes a plurality of inlets 16, and the inlet 16 is provided for the vending item to be loaded therethrough into the rotary base 20. The lower bottom plate 12 includes one outlet thereon. The outlet 17 is provided so that the rotary base 20 can rotate to discharge therethrough the vending item. The rotary base 20 is pivotally connected inside the fixed frame 10; the rotary base 20 includes an upper rotary disk 21, a lower rotary disk 22 and a plurality of connection elements 23. The upper rotary disk 21 and the lower rotary disk 22 both include a plurality of through holes 24, the through holes 24 of the upper rotary disk 21 are arranged corresponding to the through holes 24 of the lower rotary disk 22. The connection elements 23 are fixed to peripheries of the through holes 24, and the connection elements 23 are arranged around the through hole 24 to form an accommodating space 28 for receiving the vending item (not illustrated). Furthermore, the upper rotary disk 21 and the lower rotary disk 22 each include a shaft 25, 26 pivotally connected to the corresponding pivot hole 14, 15. Moreover, a periphery of the lower rotary disk 22 includes a gear tooth surface 27, and the gear tooth surface 27 is engaged with the stepper motor device 30. The stepper motor device 30 is disposed on the lower bottom plate 12, and the stepper motor device 30 includes a transmission gear 31 to be engaged with the gear tooth surface 27 of the lower rotary disk 22. In the drawing, the stepper motor device 30 is a stepper motor.

The rotary arm mechanism 200 includes a fixed base 40, a stepper motor device 50, a drawing plate 60, a transmission module 70, a rotary arm 80, and a transition module 90. The fixed base 40 includes an upper plate 41, a lower plate 42 and a plurality of support plates 43 connected between the upper plate 41 and the lower plate 42. A transverse plate 44 is connected between the two support plates 43. The upper plate 41 and the transverse plate 44 each include a penetrating hole 45, 46. The stepper motor device 50 is fixed at one side of the transverse plate 44, the stepper motor device 50 includes a rotary shaft 51, and the rotary shaft 51 is inserted through the penetrating hole 46 of the transverse plate 44 to be connected to the transmission module 70. In the drawing, the stepper motor device 50 is a stepper motor. The drawing plate 60 is one-fourth circle shaped and is disposed on the upper plate 41 of the fixed base 40. The drawing plate 60 is adapted to hold the item hooked out by the rotary arm 80. In the drawing, the drawing plate 60 consists of stainless steel. The transmission module 70 is disposed on the upper plate 41 and is connected to the rotary shaft 51 of the stepper motor device 50. The transmission module 70 includes a bearing base 71, a bearing 72 and a transmission shaft 73. The bearing base 71 is disposed on the penetrating hole 45 of the upper plate 41, the bearing 72 is disposed in the bearing base 71, and the transmission shaft 73 is inserted through the bearing 72 to fixedly connect the rotary shaft 51 of the stepper motor device 50. The transmission shaft 73 is driven to rotate by the stepper motor device 50. The rotary arm 80 is connected to the transmission module 70. The rotary arm 80 includes an arm member 81. An opening 82 is defined on the other end of the arm member 81, the rotary arm 80 is fixed onto the transmission shaft 73 via the opening 82. A hook portion 83 in a bent blade shape extends from the other end of the arm member 81. The hook portion 83 hooks out the vending item discharged by the rotary dispensing mechanism 100. The transition module 90 is disposed at one side of the upper plate 41 of the fixed base 40. The transition module 90 includes two pivot portions 91 disposed symmetrical to each other, and a movable plate 92 is pivotally connected between the two pivot portions 91. The transition module 90 returns to its original position by means of a magnet. The transition module 90 serves to cover a gap between an adjacent mechanism and the drawing plate 60, so that the item hooked out can be conveyed stably onto the drawing plate 60.

Figure 7:
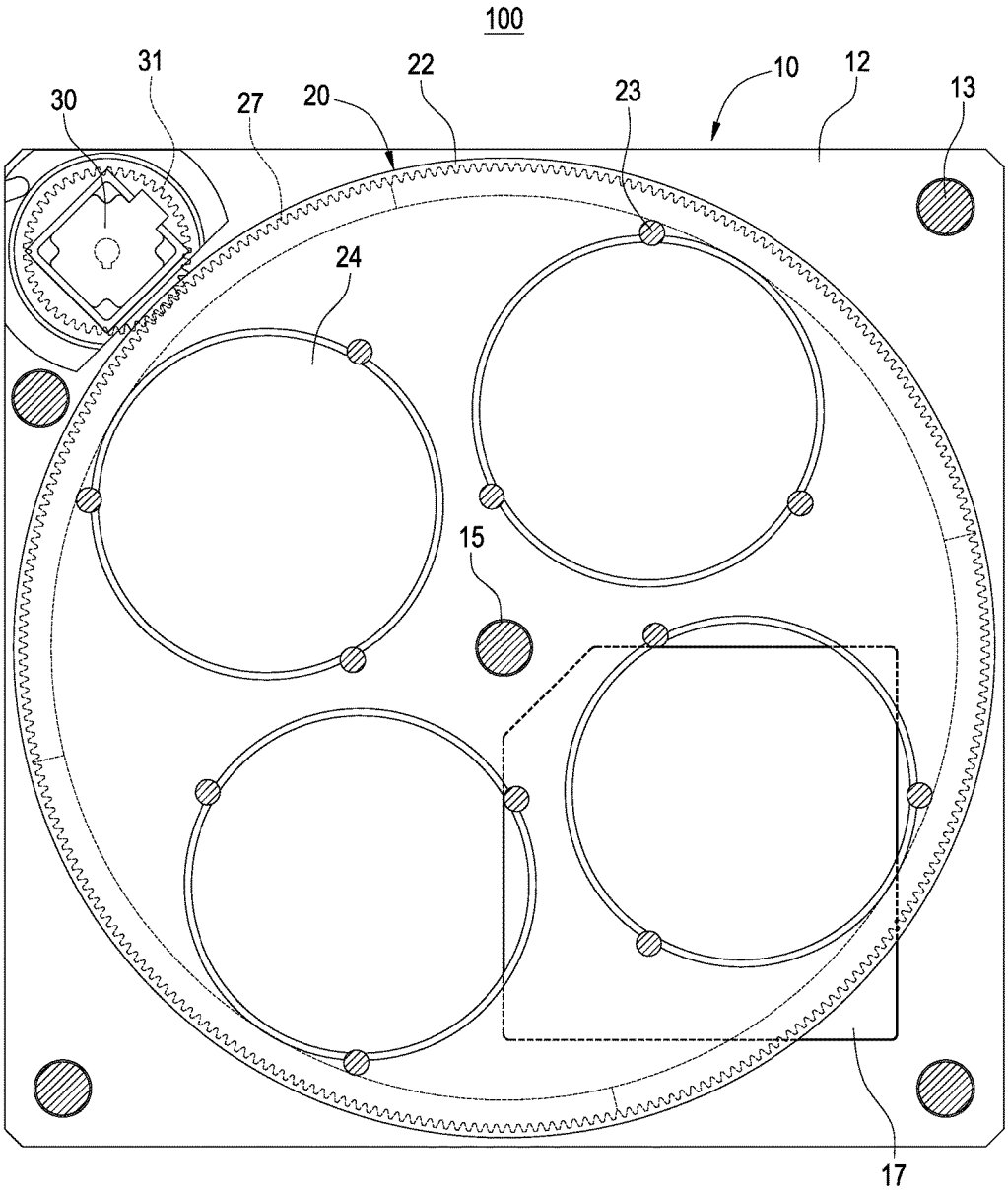
FIG. 7 is a schematic view illustrating that a stepper motor device of the rotary dispensing mechanism of FIG. 2 is engaged with a rotary base.

FIG. 7 is a schematic view illustrating that the stepper motor device of the rotary dispensing mechanism of FIG. 2 is engaged with the rotary base. As shown in the drawing, the stepper motor device 30 is disposed on the lower bottom plate 12 of the fixed frame 10, the transmission gear 31 of the stepper motor device 30 is engaged with the gear tooth surface 27 of the lower rotary disk 22, and then the control circuit installed in the vending machine (not illustrated) actuates rotation of the stepper motor device 30 according to the vending item chosen by the customer, so that the transmission gear 31 of the stepper motor device 30 drives rotation of the lower rotary disk 22, the rotary base 20 is thereby driven to rotate in the fixed frame 10, then the vending item chosen by the customer is rotated to above the outlet 17 of the lower bottom plate 12, and consequently the item can fall on a mechanism coming to receive the item.

Figure 8:
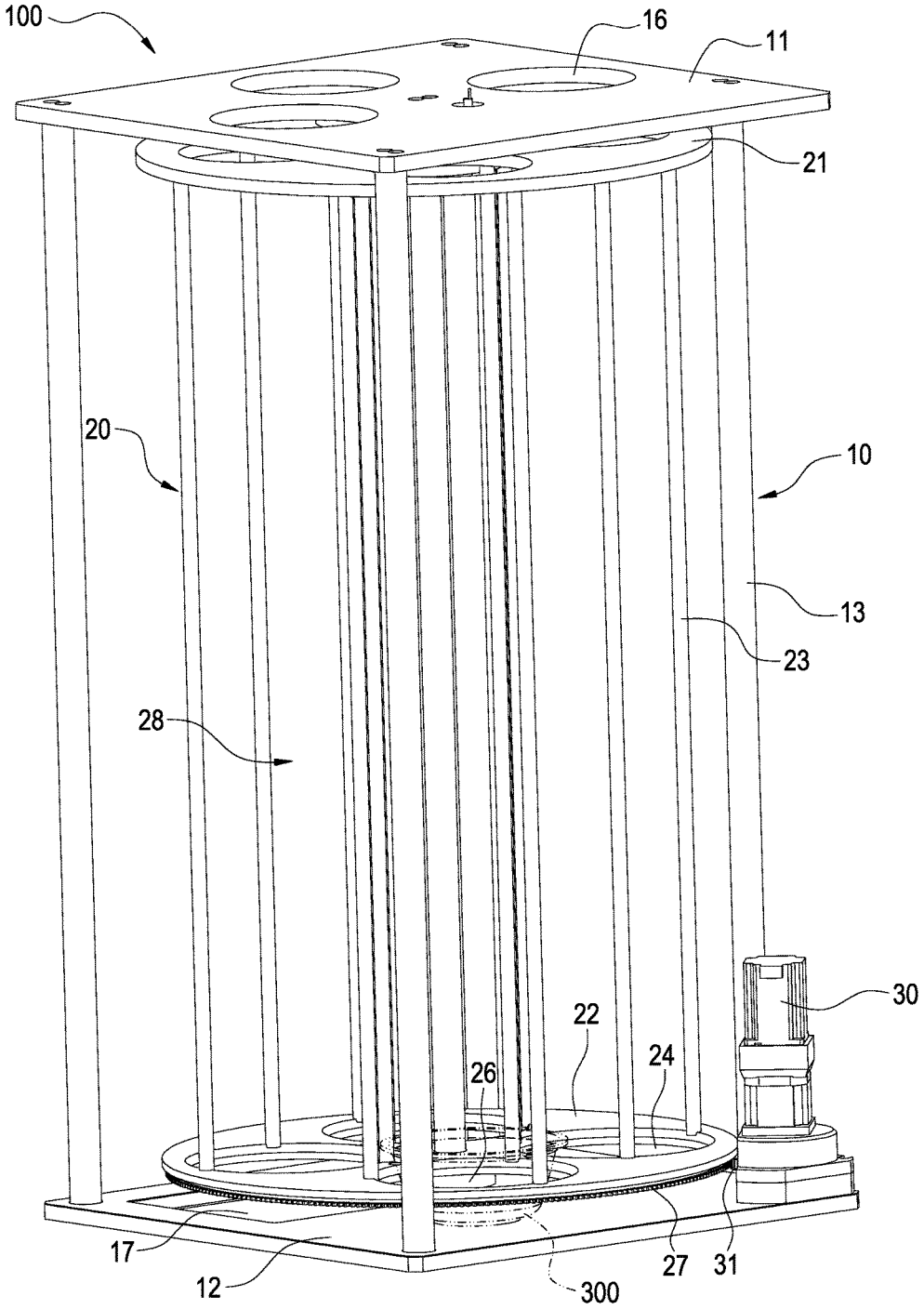
FIG. 8 is a schematic view illustrating motions of the rotary dispensing mechanism.
Figure 9:
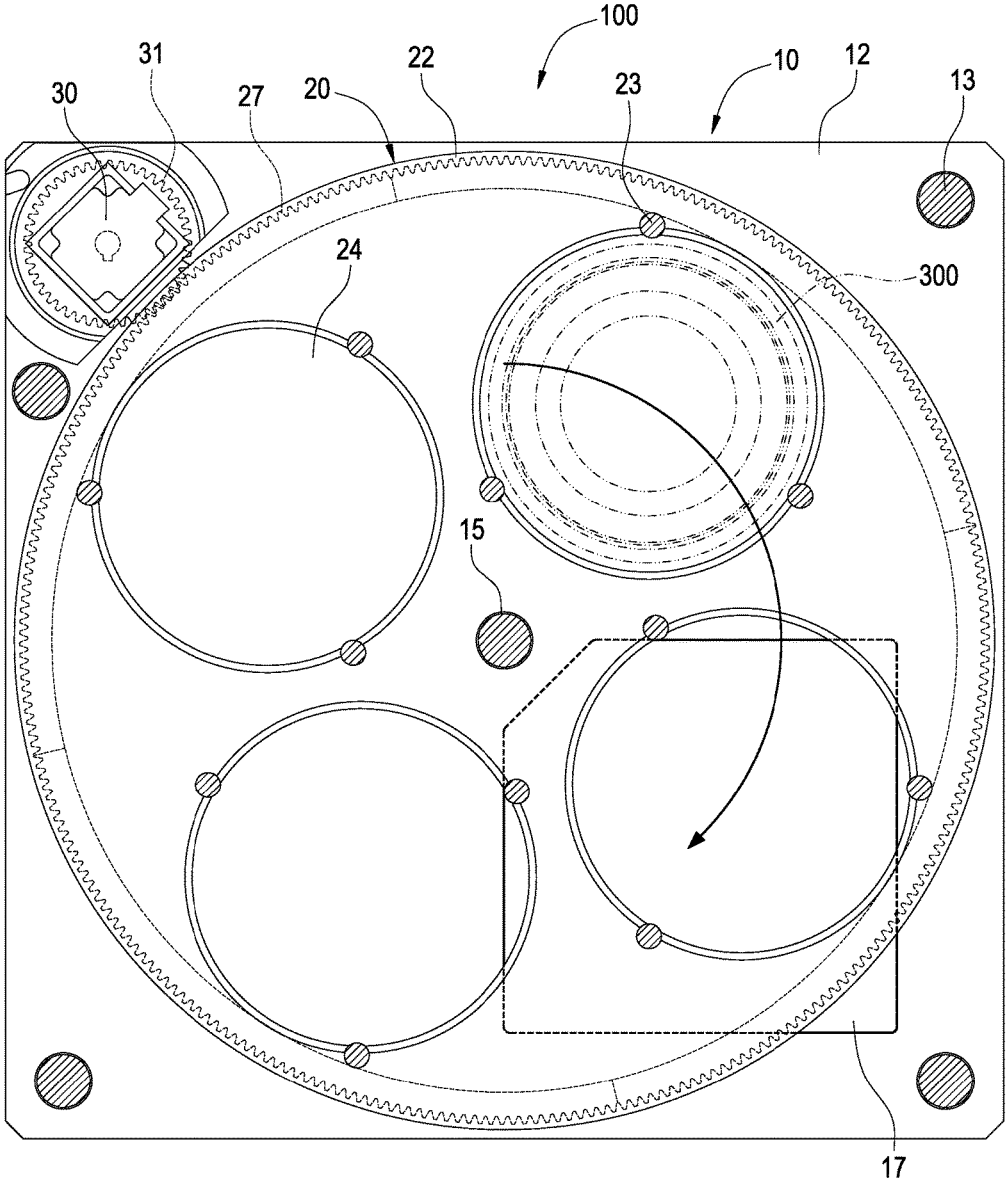
FIG. 9 is another schematic view illustrating motions of the rotary dispensing mechanism.
Figure 10:
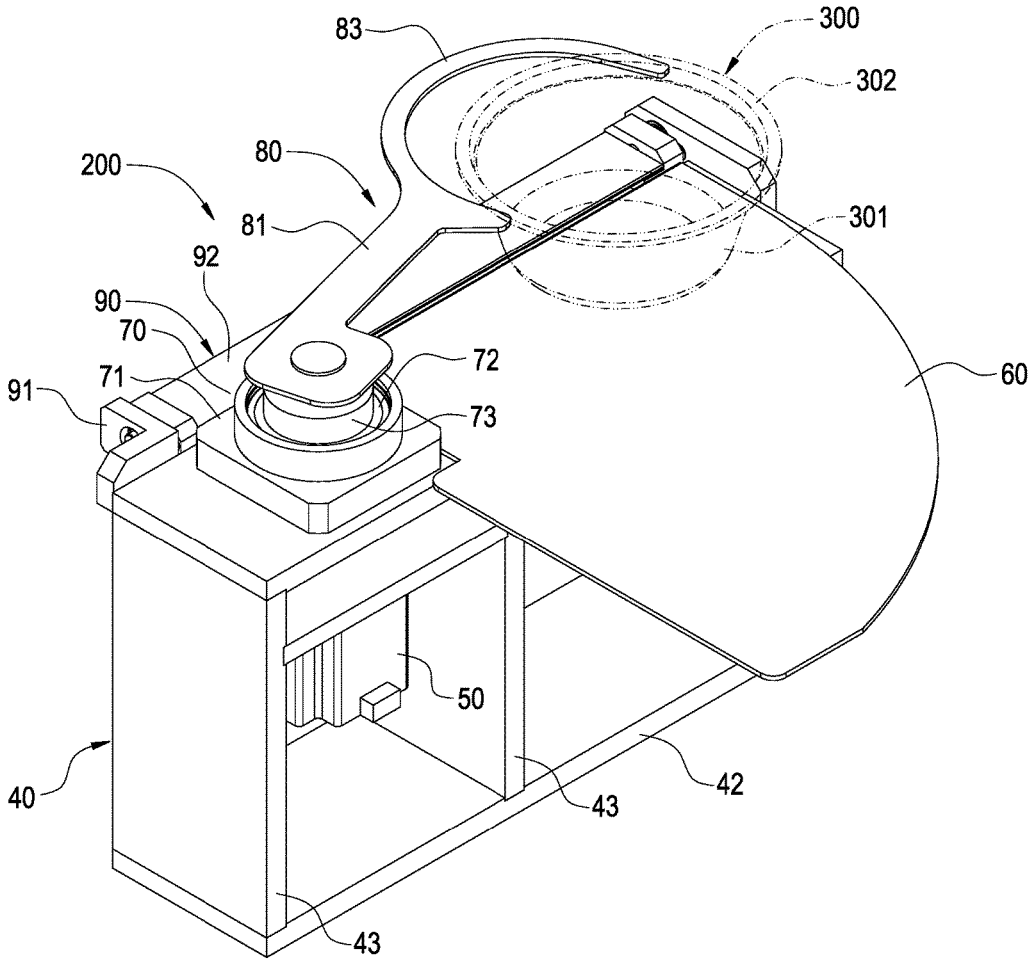
FIG. 10 is a perspective view illustrating motions of the rotary arm mechanism.
Figure 11:
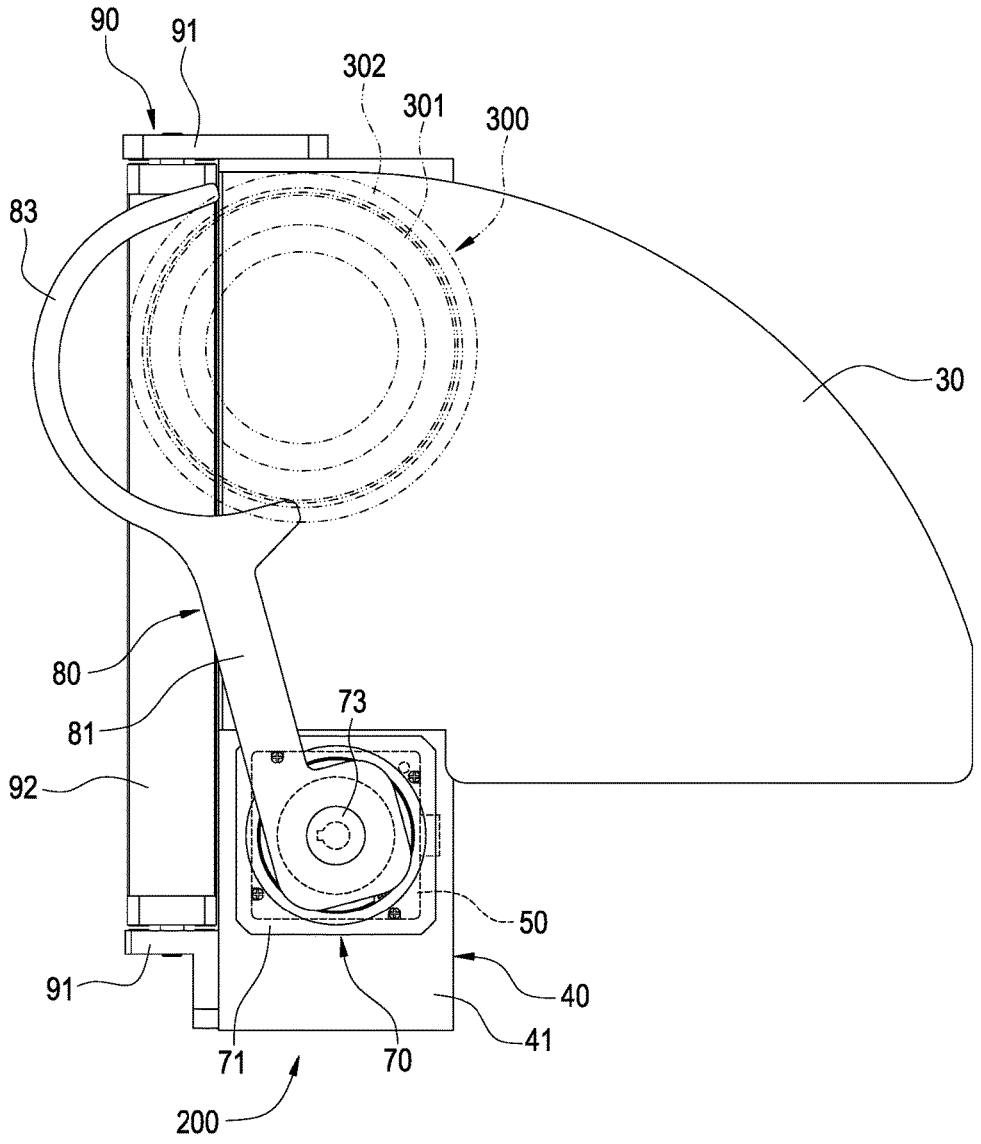
FIG. 11 is a top view illustrating the rotary arm mechanism hooking a vending item.
Figure 12:
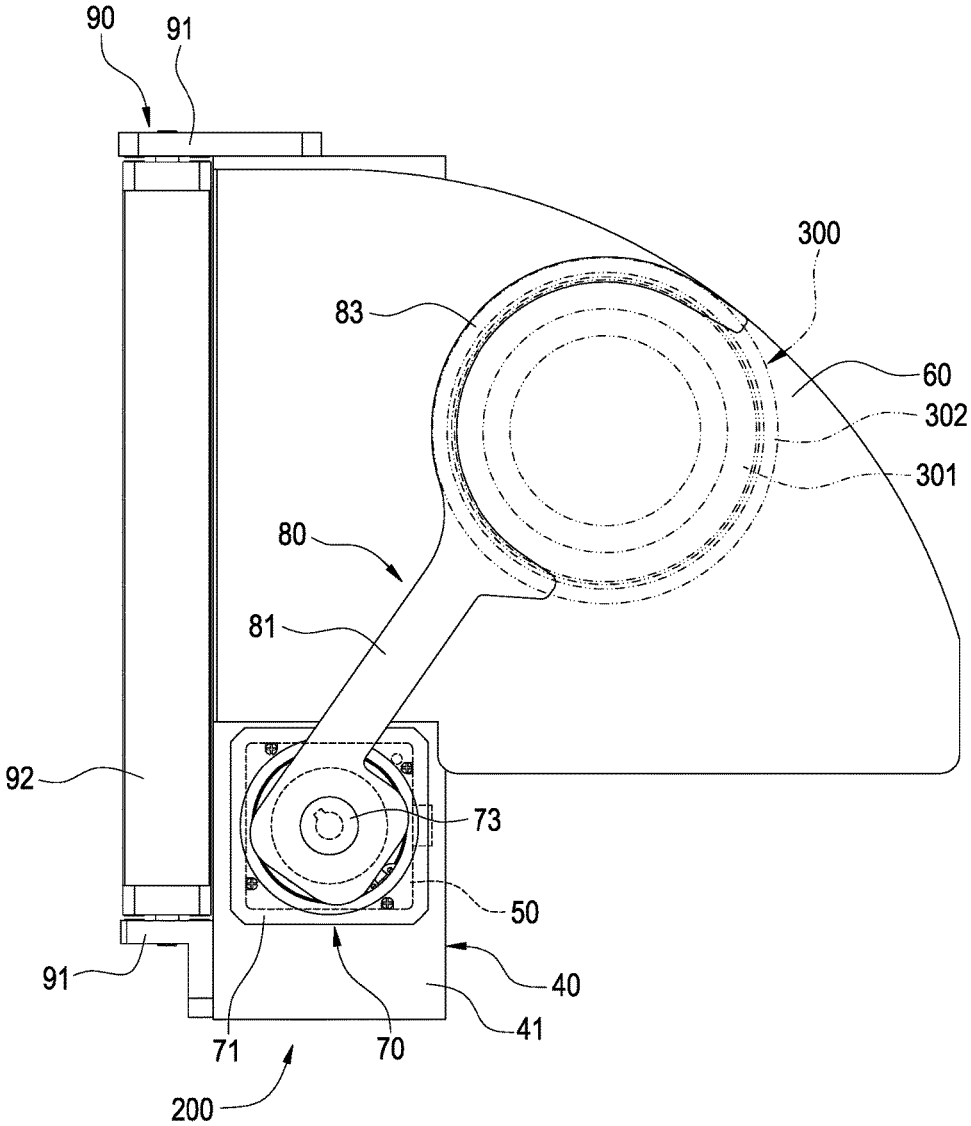
FIG. 12 is another top view illustrating the rotary arm mechanism hooking the vending item.
Figure 13:
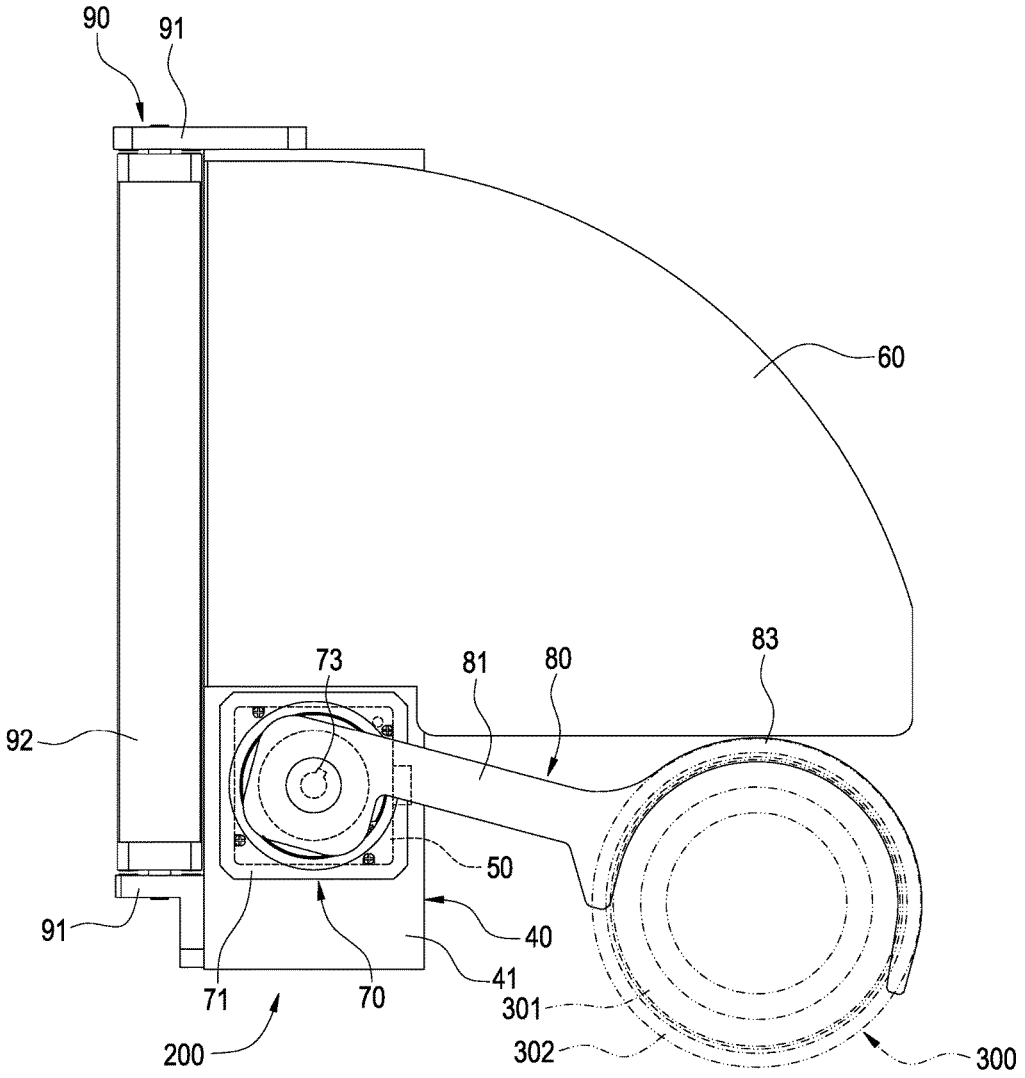
FIG. 13 is still another top view illustrating the rotary arm mechanism hooking the vending item.

FIGS. 8 and 9 are schematic views illustrating motions of the rotary dispensing mechanism. As shown in the drawings, the vending item is placed in the accommodating space 28 surrounded by the connection elements 23 in the rotary base 20, and the vending item is a bowl 300 with various flavors and food ingredients inside.

After a selection is made by the customer through a user interface of the vending machine (not illustrated), the control circuit inside the vending machine actuates rotation of the stepper motor device 30, so that the transmission gear 31 of the stepper motor device 30 drives rotation of the lower rotary disk 22 to rotate the bowl 300 chosen by the customer to above the outlet 17 of the lower bottom plate 12. At this point, the mechanism coming to receive the bowl 300 can get the bowl 300 and convey it to other mechanism for subsequent processes.

Please refer to FIGS. 10 to 13, which are a perspective view and top views showing motions that the rotary arm mechanism hooks the vending item. As shown in the drawings, the rotary arm mechanism 200 is disposed inside the vending machine. After the rotary dispensing mechanism 100 discharges the vending item, the control circuit (not illustrated) of the vending machine actuates rotation of the stepper motor device 50, so that the rotary shaft 51 of the stepper motor device 50 drives rotation of the transmission module 70. Being driven, the rotary arm 80 first swings to one side. When the vending item is sent to one side of the drawing plate 60, and the vending item is the bowl 300, the hook portion 83 of the rotary arm 80 hooks a bowl body 301 of the bowl 300 in such a manner that a protruding rim 302 of the bowl 300 is placed on an upper edge of the hook portion 83. After the rotary arm 80 hooks out the bowl 300, the rotary arm 80 conveys it to the drawing plate 60. When an adjacent mechanism (not illustrated) at another side of the rotary arm mechanism 200 arrives, the control circuit actuates the stepper motor device 50, so that the rotary arm 80 hooks and conveys the bowl 300 to the adjacent mechanism at the another side.

When the rotary arm mechanism 100 hooks and conveys the bowl 300 to the drawing plate 60, the movable plate 92 of the transition module 90 moves in response to the movement of the rotary arm mechanism 100 to cover the gap between the adjacent mechanism and the drawing plate 60, so that the item hooked out can be stably conveyed to the drawing plate 60.

This rotation design, which enables the vending item to be rotated out, not only has a simple structure, but also takes up no storage space inside the vending machine. Accordingly, more different items with various flavors can be stored inside the vending machine.

It is to be understood that the above descriptions are merely the preferable embodiment of the present invention and are not intended to limit the scope of the present invention. Equivalent changes and modifications made in the spirit of the present invention are regarded as falling within the scope of the present invention.

What is claimed is:

1. A rotary arm mechanism for a vending machine, installed in the vending machine, comprising:

a fixed base;

a stepper motor device fixed onto the fixed base;

a drawing plate disposed on the fixed base;

a transmission module disposed on the fixed base and connected to the stepper motor device; and a rotary arm connected to the transmission module, the rotary arm including an arm member, a hook portion extending from one end of the arm member, wherein the stepper motor device is actuated by the vending machine, the stepper motor device drives the rotary arm to hook out and convey a vending item in the vending machine, wherein the fixed base includes an upper plate, a lower plate and a plurality of support plates connected between the upper plate and the lower plate, a transverse plate is connected between the two support plates, and the upper plate and the transverse plate each include a penetrating hole;

wherein the drawing plate is one-fourth circle shaped and is disposed on the upper plate of the fixed base.

2. The rotary arm mechanism for the vending machine according to claim 1, wherein the stepper motor device is fixed at one side of the transverse plate, the stepper motor device includes a rotary shaft, and the rotary shaft is inserted through the penetrating hole of the transverse plate.

3. The rotary arm mechanism for the vending machine according to claim 2, wherein the stepper motor device is a stepper motor.

4. The rotary arm mechanism for the vending machine according to claim 1, wherein the drawing plate consists of stainless steel.

5. The rotary arm mechanism for the vending machine according to claim 1, wherein an opening is defined on the other end of the arm member, and the rotary arm is fixed onto the transmission module via the opening.

6. The rotary arm mechanism for the vending machine according to claim 5, wherein the hook portion is in a bent blade shape.

7. A rotary arm mechanism for a vending machine, installed in the vending machine, comprising:

a fixed base;

a stepper motor device fixed onto the fixed base;

a drawing plate disposed on the fixed base;

a transmission module disposed on the fixed base and connected to the stepper motor device; and a rotary arm connected to the transmission module, the rotary arm including an arm member, a hook portion extending from one end of the arm member, wherein the stepper motor device is actuated by the vending machine, the stepper motor device drives the rotary arm to hook out and convey a vending item in the vending machine, wherein the fixed base includes an upper plate, a lower plate and a plurality of support plates connected between the upper plate and the lower plate, a transverse plate is connected between the two support plates, and the upper plate and the transverse plate each include a penetrating hole;

wherein the transmission module includes a bearing base, a bearing and a transmission shaft, the bearing base is disposed on the penetrating hole of the upper plate, the bearing is disposed in the bearing base, and the transmission shaft is inserted through the bearing to connect the stepper motor device.

8. The rotary arm mechanism for the vending machine according to claim 7, wherein the stepper motor device is fixed at one side of the transverse plate, the stepper motor device includes a rotary shaft, and the rotary shaft is inserted through the penetrating hole of the transverse plate.

9. The rotary arm mechanism for the vending machine according to claim 8, wherein the stepper motor device is a stepper motor.

10. The rotary arm mechanism for the vending machine according to claim 7, wherein the drawing plate consists of stainless steel.

11. The rotary arm mechanism for the vending machine according to claim 7, wherein an opening is defined on the other end of the arm member, and the rotary arm is fixed onto the transmission module via the opening.

12. The rotary arm mechanism for the vending machine according to claim 11, wherein the hook portion is in a bent blade shape.

13. A rotary arm mechanism for a vending machine, installed in the vending machine, comprising:

a fixed base;

a stepper motor device fixed onto the fixed base;

a drawing plate disposed on the fixed base;

a transmission module disposed on the fixed base and connected to the stepper motor device;

a rotary arm connected to the transmission module, the rotary arm including an arm member, a hook portion extending from one end of the arm member, wherein the stepper motor device is actuated by the vending machine, the stepper motor device drives the rotary arm to hook out and convey a vending item in the vending machine; and a transition module, the transition module being disposed in the fixed base, the transition module including two pivot portions disposed symmetrical to each other, a movable plate being pivotally connected between the two pivot portions.

14. The rotary arm mechanism for the vending machine according to claim 13, wherein the transition module returns to its original position by a magnet.

* * * * *